US005295445A

United States Patent [19]

Locke et al.

[11] Patent Number: 5,295,445

[45] Date of Patent: Mar. 22, 1994

[54] SPACER DEVICE FOR USE IN COOLING CONTAINERS SUPPORTED THEREON TO THE TEMPERATURE OF THE SURROUNDING ENVIRONMENT

[75] Inventors: William J. Locke, 1 Ponderosa Way, Evergreen, Colo. 80439; Thomas G. Jensen, Littleton, Colo.

[73] Assignee: William J. Locke, Golden, Colo.

[21] Appl. No.: 705,281

[22] Filed: May 24, 1991

[51] Int. Cl.[5] ..... B65D 19/38

[52] U.S. Cl. ..... 108/57.1; 108/51.1

[58] Field of Search ..... 108/51.1, 53.1, 55.3, 108/55.1, 57.1

[56] References Cited

U.S. PATENT DOCUMENTS

| | | | |
|---|---|---|---|
| 2,148,150 | 2/1939 | Clark | 108/57.1 |
| 2,455,197 | 11/1948 | Sullivan | 108/57.1 |
| 2,692,107 | 10/1954 | Ridder | 108/51.1 |
| 5,101,737 | 5/1992 | Gomez | 108/51.1 |

FOREIGN PATENT DOCUMENTS 2333811 3/1974 Fed. Rep. of Germany ..... 108/51.1

*Primary Examiner*—Kenneth J. Dorner
*Assistant Examiner*—Gerald A. Anderson
*Attorney, Agent, or Firm*—Timothy J. Martin; Dana S. Rewoldt

[57] ABSTRACT

The invention is a pallet useful as a spacer with containers for heat transfer. The invention includes a plurality of longitudinal and lateral elongated U-shaped channel members having a bottom, sidewalls and flanges at the ends of sidewalls. Each of the members of one of the groups generally opposed to the members of the other group and at right angles to the other group with the bottom of each member of each group facing outward. Strengthening plates are disposed at the intersections of the members which are efficient in transferring thermal energy.

13 Claims, 4 Drawing Sheets

SPACER DEVICE FOR USE IN COOLING CONTAINERS SUPPORTED THEREON TO THE TEMPERATURE OF THE SURROUNDING ENVIRONMENT

FIELD OF INVENTION

The present invention generally relates to devices for supporting containers in a spaced apart relationship in a temperature regulated environment. Specifically, the present invention concerns spacer devices used in freezer facilities to support packaged unfrozen foods that are being frozen or chilled.

BACKGROUND OF THE INVENTION

In the last hundred years the method for storing perishable foods has undergone a remarkable change. Perishable foods were originally smoked, salted, dried or canned in an effort to preserve them for future use. As the industrial revolution progressed and cooling devices were invented, the preservation of perishable foods turned to the use of freezing as a storage and preservation technique. In particular, the meat processing industry grew to rely more heavily on large, centralized meat packing plants where meat was cut and then placed in large freezing facilities for subsequent distribution to wholesalers.

Early on in the meat packing industry it was discovered that packing raw or slightly cooled meat into boxes for freezing could cause meat spoilage if the boxes were packed too closely together such that the most interior box was insulated from the cooling environment by the outer product. That is, an interiorly located box would not be adequately cooled and the meat therein would spoil in transit. To eliminate the problem of self insulation, wood pallets were used as spacers to stack the boxes in a spaced apart relationship such that the cooled air of the freezer could circulate in and around the boxes. Wood pallets worked well; however, wood was not very efficient in conducting or transferring thermal energy. It was later learned that pallets made out of aluminum decreased the time in which it took to freeze the boxes of meat to the temperature desired. The aluminum pallets cooled the containers approximately 30% faster than did the wood pallets.

At least as early as the mid-1970's, spacer devices were formed out of aluminum for use in meat packing freezers. This spacer device was made of a heavy, rigid aluminum and it was formed of U-shaped channels that had ridges on the upper surface that supported the containers. The U-shaped channels had sidewalls that terminated in flanges that extended outwardly. These flanges were then connected to the flanges of a second set of U-shaped channels that were inverted and disposed transversely of the first set so that at the points of intersection channels opened up into one another. This aluminum pallet did increase the thermal transfer between the environment and the container for more rapidly cooling the containers to the freezer temperature. However, this aluminum spacer had disadvantages. The ridged surface presented less contact surface against the container thus limiting the amount of thermal transfer from the spacer. The gauge of aluminum used to achieve the strength necessary to support the boxes was fairly heavy, the weight of the spacer was also increased by the depth of the U-shaped channels which had sidewalls of approximately one inch in height; therefore, the spacers were massive and clumsy. Also the flanges were of a narrow width that allowed deformation when riveted together. These deformed flanges often caught and snagged the boxes and containers that were placed on the spacer device.

To avoid some of the difficulties associated with the earlier aluminum spacers, another prior art construction was developed. This second aluminum spacer had a first set of U-shaped channel pieces and a second set of U-shaped channel pieces that were disposed at right angles to one another, but the flanges were eliminated. One set of channel pieces had a portion of the sidewall cut out so that the second set of channel pieces fit securely within the first set of channel walls. This arrangement was somewhat reminiscent of the corner saddle-notch for log cabins. This second construction utilized a lighter weight aluminum which cooled the containers more efficiently than did the ridged, thick aluminum spacer. However, it had several new disadvantages. One, the boxes tended to deform and snag on the channel rims since it was raised to a height that allowed contact with the container if the container is heavy enough to cause the spacer to bend slightly. The sidewalls had to be greater than $\frac{5}{8}$ inch in height to accommodate the saddle notch construction. Also, the saddle-notches were difficult to secure and required an expensive welding step in fabrication. Finally, since the intersecting channels were arranged to lie within the open channel, less circulation of the air was permitted and this decreased the efficiency of the thermal transfer of energy.

Thus, there remained a need for a lightweight metal spacer that has open channels and a flat contact surfaces to maximize the efficiency of the thermal transferring surfaces. Further, there is a need for a spacer device which reduces the incident of snagging containers supported thereon. There is also a need for a lightweight channel system that can efficiently transfer heat and act as a heat sink while being of sufficient structural strength to maintain its shape under the weight of the supported containers.

SUMMARY OF THE INVENTION

It is an object of the present invention to provide a new and useful space device construction that is easy and inexpensive to manufacture and that is easy to use when supporting containers for heat transfer.

Yet another object of the present invention to provide a lightweight spacer device capable of supporting heavy containers without deformation of the shape of the spacer device.

A further object of the present invention is to provide a spacer device that does not have upturned edges that can snag containers supported thereon.

It is still a further object of the present invention to provide a lightweight, spacer device that is efficient in transferring thermal energy.

Another object of the present invention is to provide a spacer device that is strengthened such that it can maintain its shape when heavy food containers are supported on it and also maintain or increase the thermal transferring properties of the device.

In the broad form of the present invention, then, a spacer device is adapted to support containers having a first temperature for heat exchange with an environment at a second temperature. The spacer device of the present invention broadly includes a plurality of elongated U-shaped first channel members each having a longitudinal axis. Each first channel member is formed to have a first planar bottom wall and a pair of first sidewalls that are connected to the first bottom wall to form a first U-shaped channel. The first sidewalls each project upwardly from the bottom wall and terminate in a laterally projecting flanges. The flange on each respective sidewall projects oppositely from one another in a substantially parallel spaced apart relation to the bottom wall. The first channel members are organized as a first set with each of the first channel members in the first set being positioned in a spaced apart parallel relation one to another and oriented so that the U-shaped channels open in a common first direction. The spacer device also has plurality of elongated U-shaped second channel members each having a longitudinal axis. The second U-shaped channel members are also formed by a second planar bottom wall and a pair of second sidewalls connected to the bottom wall to form a U-shaped second channel. The second sidewalls each project upwardly from second bottom wall and terminate in laterally projecting second flanges. The second flanges also project oppositely from one another in a substantially parallel spaced apart relationship to the second bottom wall. The second channel members are organized as second set with the second channel members in the second set being positioned in a spaced apart parallel relation to one another. The U-shaped channels of the second set open in a common second direction opposite the first opening of the first channels with each of the second channels oriented transversely to the first channel members so that the first and second channel members cross one another at intersections and so that the first and second channels open toward one another; thus, the first and second flanges at the intersections are proximate one another. The flanges of the first channel members of the first set and the flanges of the second channel members of the second set are then rigidly attached to one another at selected attachment locations at the points of intersection.

When used, the first and second bottom walls are positioned to contact and support the containers so that bottom walls define outwardly disposed thermal transfer surfaces which are operative to transfer thermal energy between the first and second members and the container. The first and second sidewalls and the first and second flanges define radiant surfaces which are operative to transfer thermal energy between the first and second channel members and the environment. The spacer device is usually formed of first and second channel members made of a metal such as steel, tin, aluminum, iron, copper and nickel. While the attachment structure that interconnects the first and second channel members may be rivets, screws and the like, preferably the attachment means includes a crimped region of the first and second channel members in the flange. Each of the first and second flanges have outer edges, and the flanges are sized and configured at the attachment locations to receive the rivet or crimping means without substantial deformation of the outer edge of the flange.

If desired the first set of channel members can include a first central channel member that has a width that is greater than the width of the other, outer first channel members. Likewise, the second set of second channel members can include a central second channel member that has a width greater than the width of the other, outer second channel members. In any event, a strengthening plate may be interposed between one or more of the first channel members and second channel members proximate the attachment locations and preferably at the intersections of the first and second members. Each of the strengthening plates has a planar central portion at the respective intersection and plurality of wing portions that extend outwardly from the central portion in a common plane therewith along side their respective first and second channel members which define the respective intersection. The wings terminate in an outer wing edge. The wing portions extend across the flanges of the respective first and second channel members so that additional attachments between the flanges and the strengthening plates can be made.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

The present invention is generally directed to a spacer device which can be used to support containers in a manner that allows air circulation and rapid thermal transfer of heat between the containers and a storage environment. Preferably, the spacer device is formed to provide heat transferring surfaces which permit the temperature of the containers to be lowered approximately to the temperature of the surrounding environment, such as a refrigerated storage area. For example, the present invention is particularly useful to support containers of food, especially meat, for freezing.

Figure 1:
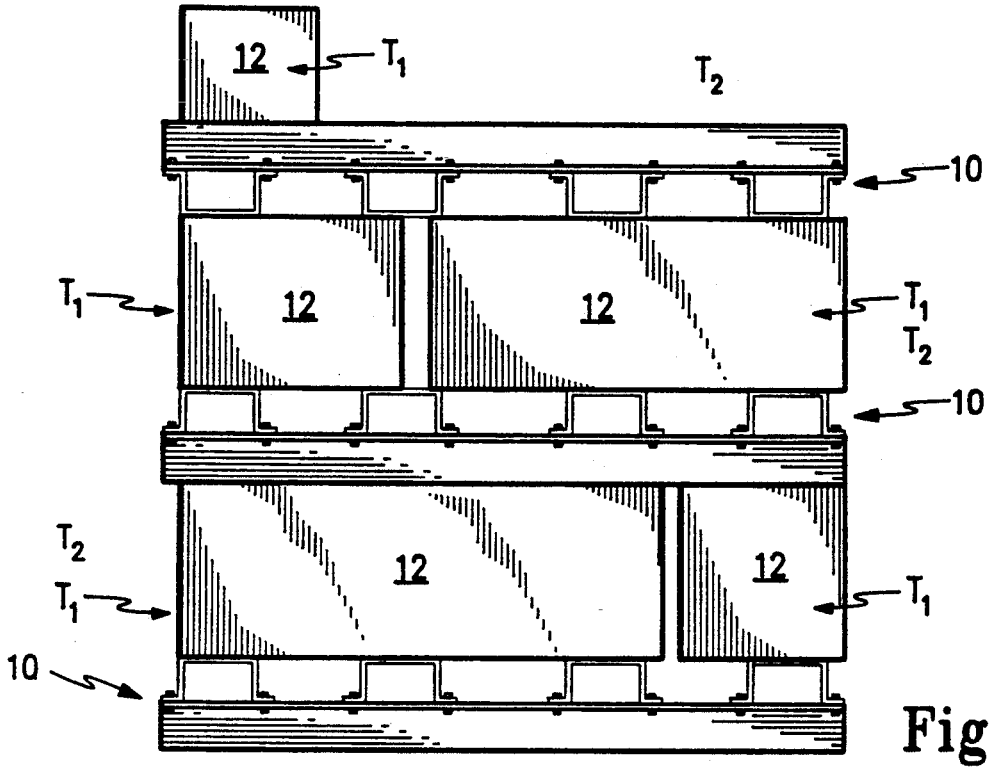
FIG. 1 is a side view in elevation of three spacer devices according to the present invention in use with a plurality of containers supported thereon.

A first exemplary embodiment of the present invention is shown in use in FIG. 1 wherein spacer devices 10 support a plurality of containers 12 which may hold a foodstuff. Containers 12 are in three layers each separated by a spacer device 10. Containers 12 are at a first temperature $T_1$ and are stored in an environment at a second temperature $T_2$ which may be any housing such as a refrigerator, warehouse, truck, etc. While temperature $T_1$ may be hotter or colder than temperature $T_2$, the spacer device 10 is particularly useful in the freezing of contents in containers 12 so that, typically, $T_2$ is below freezing and $T_1$ is initially above freezing. In either event, the spacer devices 10 are operative to allow thermal transfer of heat between the containers 12 and the environment.

Figure 2:
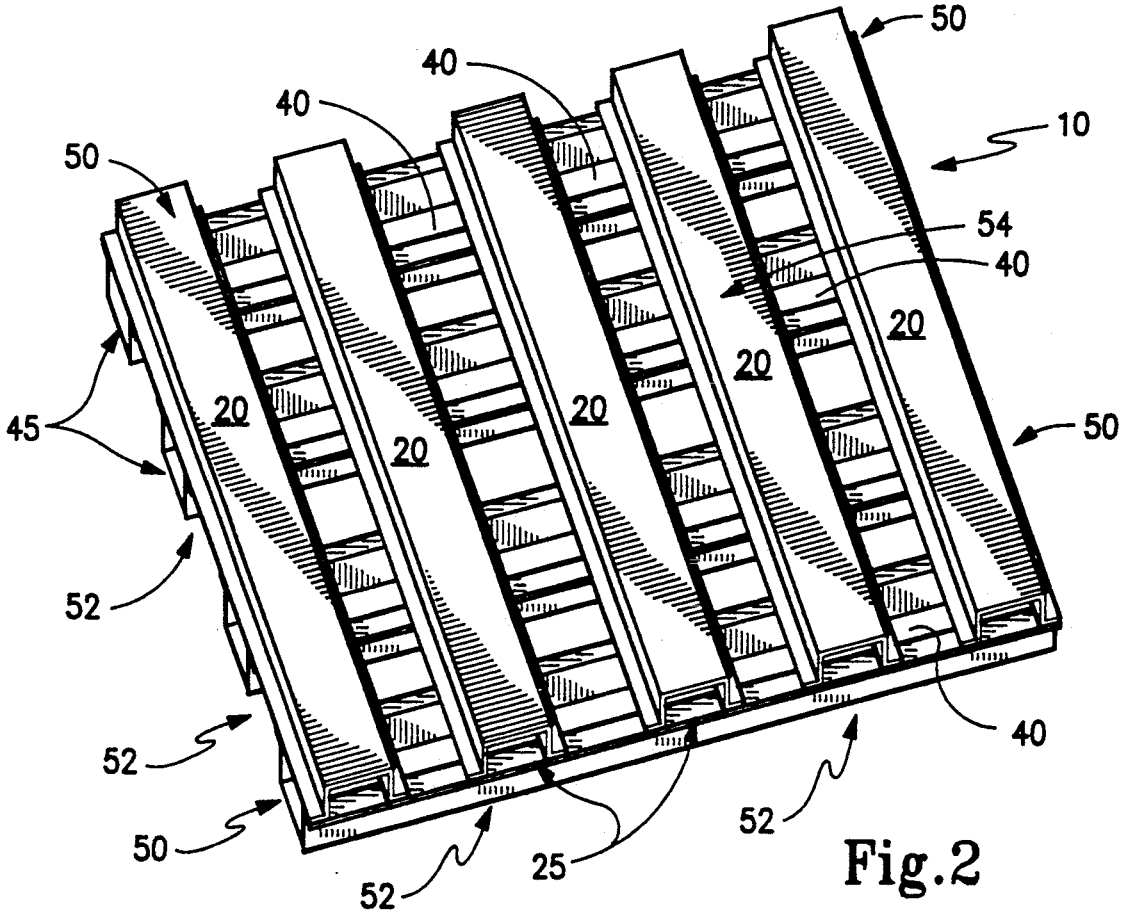
FIG. 2 is a perspective view of a spacer device according to an exemplary embodiment of the present invention.
Figure 3:
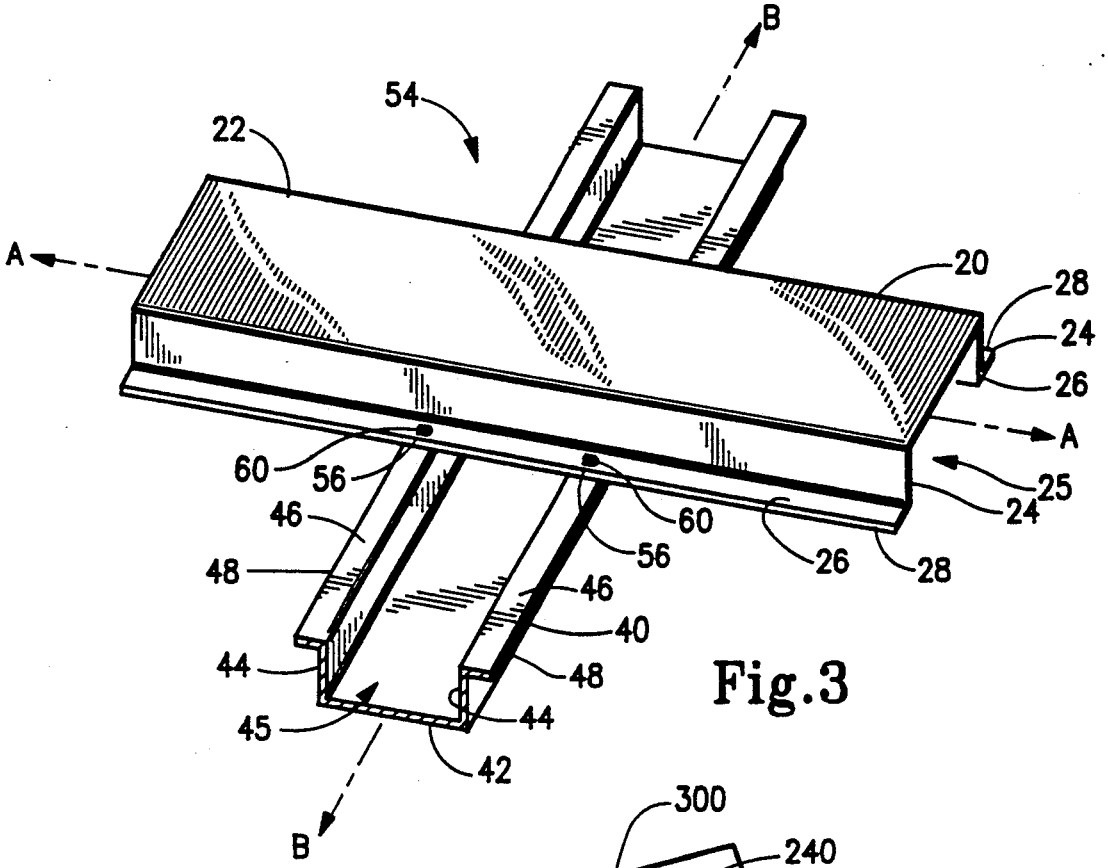
FIG. 3 is a perspective view showing an intersection of a pair of U-shaped members used to construct the spacer device of FIGS. 1 and 2.

The construction of first exemplary spacer device 10 is best shown in FIGS. 2 and 3. Here, spacer device 10 is formed by a first set of five elongated U-shaped first channel members 20 and a second set of four elongated second channel members 40. It should be understood, however, that different numbers of channel members could be organized to fabricate a channel device according the the present invention. Each of the first channel members 20 are positioned in a spaced-apart parallel relationship to one another with channels 25 of the channel members 20 opening in a common direction. Second channel members 40 are positioned in a spaced-apart parallel relationship to one another with the U-shaped channels 40 having channels 45 oriented in a second direction and opening oppositely of the U-shaped channels 25 of first channels 20. That is, first and second channel members 20 and 40 are inverted with respect to one another. Each of second channel members 40 is oriented transversely channel members 20 and are preferably perpendicular thereto. Accordingly, first and second channel members 20 and 40 cross one another at intersections such as corner intersections 50, edge intersections 52 and central intersections 54.

Turning to FIG. 3 the construction of representative first and second channel members can be seen with greater particularity. The first channel member 20 has a longitudinal axis A and the first U-shaped channel member 20 is formed of a planar first bottom wall 22 and a pair of first sidewalls 24 connected to the bottom wall 22 to form the U-shaped channel 25. The sidewalls 24 each project upwardly from the bottom wall 22 and terminate in laterally projecting first flange 26 with the flanges oppositely projecting one from another in a substantially parallel spaced-apart relationship to the first bottom wall 22. Accordingly, first channel member has a width measure between first sidewalls 24.

Likewise, the U-shaped second channel member 40 it has a longitudinal axis B. The U-shaped second channel member 40 is formed by a planar second bottom wall 42 and a pair of second sidewalls 44 that are connected to the second bottom wall 42 to form the U-shaped channel 45. Each second sidewall 42 projects upwardly from the bottom wall 42 and terminates in a laterally projecting second flange 46. Each of the second flanges 46 project oppositely from one another in a substantially parallel spaced-apart relationship to the second bottom wall 42. Channel members 20 and 40 are shown crossing one another in FIG. 3 at a representative central intersection 54 so that the flanges 46 of the second U-shaped channel 40 and the flanges 26 of the first U-shaped channel 20 are proximate one another and, in this embodiment, the flanges actually contact one another.

As can be further seen in reference to FIG. 3, there are attachment means for attaching the flanges 26 and the flanges 46 at selected attachment locations 56. Preferably, there are four attachment locations 56 at each intersection 54 so that the flanges 26 and 46 are secured and the first and second bottom walls 22 and 42 of the first and second U-shaped channel members 20 and 40 are positioned facing one another such that the U-shaped channels 25 and 45 open into one another. A variety of means for attaching the flanges 26 and 46 can be employed. The preferred method of attachment is a crimped region 60 wherein one portion of the flange 26 is deformed to snugly fit in a similarly shaped deformation of the second flange 46 as is known in the art. Each of the first and second flanges 26 and 46 have an outer edge 28 and 48, respectively. The respective flanges 26 and 46 are thus sized and configured so that at the attachment locations 52 the flanges 26 and 46 can receive the respective crimping 60 without substantial deformation of the respective outer edges 28 and 48 respectively. Preferably, the flanges 26 and 46 are approximately 0.530 inches in width. This substantially reduces the problem of snagging the container 12 which is positioned on the respective spacer device 10.

The first and second U-shaped channel members 20 and 40 are preferably formed by aluminum extrusion; although other methods can be employed, for example, roll formed aluminum. Metal construction is preferred, and the metal may be selected from a group preferably consisting of: steel, tin, aluminum, iron, copper, nickel or other suitable metals and alloys thereof. In the preferred embodiment of the present invention one set of the U-shaped channels are approximately 48 inches in length, ½ inch in height, the second set of U-shaped channel can be formed to be either 48 inches long or 40 inches long with the preferable length being 40 inches long and having a ½ inch in height creating an overall height of one inch for each spacer device. The thickness of the U-shaped channels are approximately 0.0032 of an inch. In the preferred embodiment of the present invention the aluminum used is preferably 3105-H16 or 3105-H28. The U-shaped channel bottom wall of both the first and second channel is approximately 2 inches in width.

The prior art metal spacer device first discussed in the background section of this disclosure was formed out of heavy gauge metal. Light weight metal was believed not to be capable of undergoing the stress of the weight and temperature changes without deformation of the ridged surface. It was believed to fracture under approximately 2,000 pounds of weight per spacer device. The present spacer device 10 has been tested to 3,000 pounds, and little or no deformation of the surface of the device was observed under this weight. Further due to the various temperatures at which the spacer device is employed, it has been strength tested by repeated temperature tests. The spacer device 10 was placed at a temperature of −40° for a minimum of one hour and then allowed to return to room temperature. There was virtually no difference in the thermal transfer coefficient of the spacer device 10 under these conditions.

Figure 4:
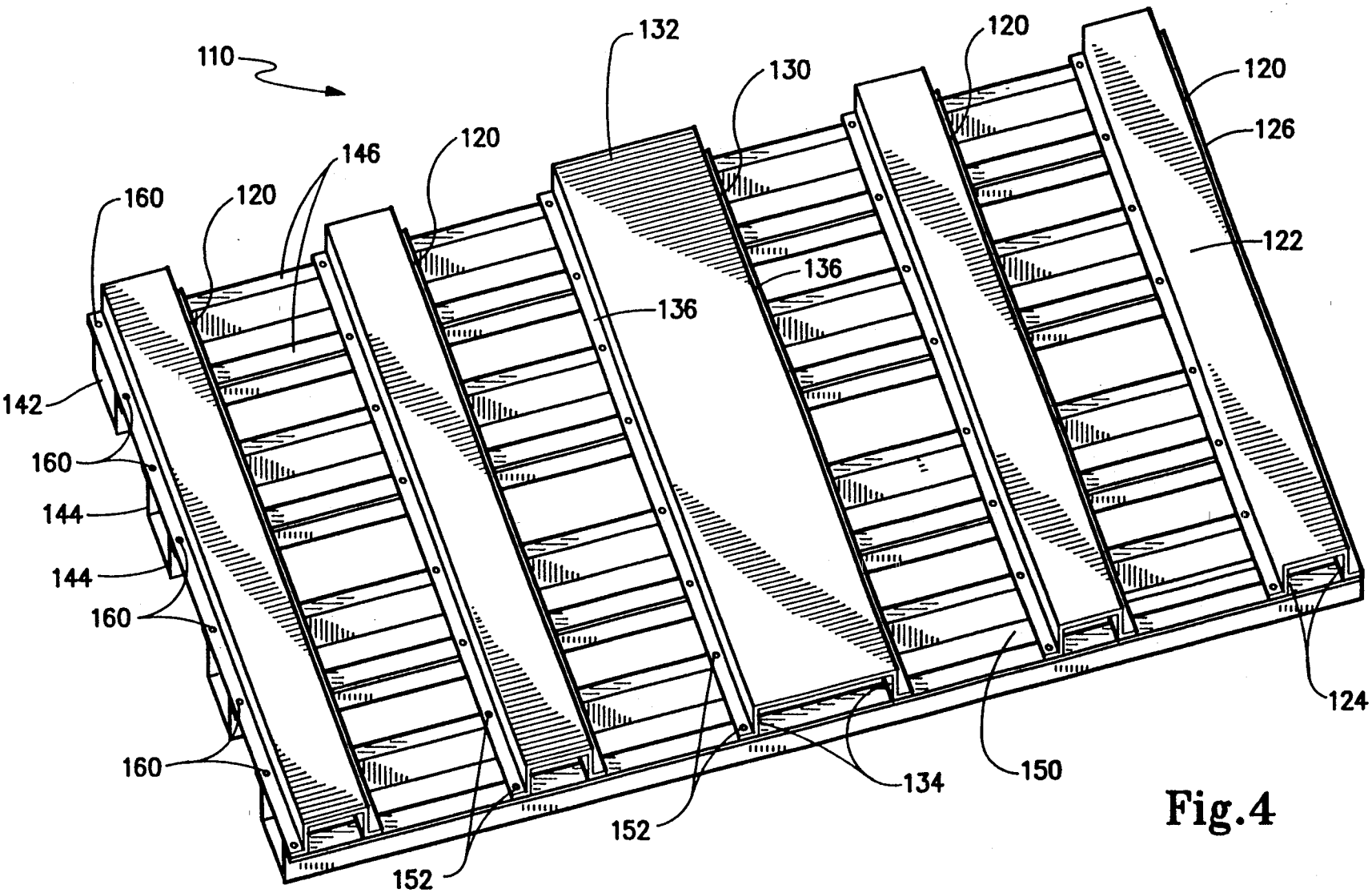
FIG. 4 is a perspective view of an alternative exemplary embodiment of the spacer device including an enlarged central U-shaped member.

A first alternative exemplary embodiment of the present invention is shown in FIG. 4; here spacer device 110 is structured similarly to the spacer device 10 and includes outer U-shaped first channel members 120, U-shaped first central channel member 130 and second U-shaped channel members 140. As in the previous embodiment, the channels members 120, 130 and 140 each have a longitudinal axis. The first and second channels 120,140 are formed with bottom walls 122 and 142, respectively and a pair of sidewalls 124, 144 respectively that interconnect to form a U-shaped channel. The sidewalls 124 and 144 each terminate in laterally projecting flanges 126,146 respectively that project parallel to the bottom walls 122,142 respectively. Likewise, central channel member 130 has a bottom wall 132, sidewalls 134 and outwardly projecting flanges 136. Again, the first channel members 120 and central channel member 130 are organized as a first set with each of the first channel members 120,130 being positioned in a spaced-apart parallel relationship to one another. A second set of channel members 140 are organized in the second set which are oriented in cross-wise contact with first channels members 120,130. The U-shaped channels of the first set open in a first direction and the U-shaped channels for the second set open in a second direction such that at the point of intersection 150 the channels are opening into one another. The spacer device 110 has attachment means for rigidly attaching the flanges 126,136 of the first channel members 120,130 to the flanges 146 of the second channel members 140 at selected attachment locations 152. Here, however, the attachments means are rivets 160, and it should be appreciated that flanges 126 and 146 are sized so that rivets 160 rigidly secure the first and second channel members 120 and 140 together without deformation of the outer edges of flanges 126 and 146.

Unlike the first embodiment wherein the width of the first and second channel members were the same, in this first alternative embodiment first central channel member 130 has a width (between its sidewalls 134) that is greater than the width of the first outer channel members 120. Preferably, the central channel members 130 width is 50% larger than the width of the first outer channel members 120. Because the central channel member's bottom wall 122 is approximately 50% wider than the outer members there is a 50% wider contact area for support of the containers. The central channel member's bottom wall 132 thus defines an outwardly disposed thermal transfer surface and is operative to transfer heat. As in the first embodiment the first and second sidewalls 124, 134 and 144 and the first and second flanges 126, 136 and 146, define radiant surfaces that are operative to transfer heat between the first and second channel members 120, 130 and 140 and the environment. Because stacking containers one against each other on a spacer tends to insulate the most interior portion of the container, the central channel member 130 is operative to provide a larger thermal transfer surface area for transferring the heat between the channel members and this interior portion of each container. Thus, the wider central channel member 130 is functional to reduce hot spots which do not efficiently cool the containers. Further, the wider central channel member 130 strengthens the spacer device 110 such that an increased amount of container weight can be applied to the surface without deformation of the spacer device 10 from a flat plane.

Figure 5:
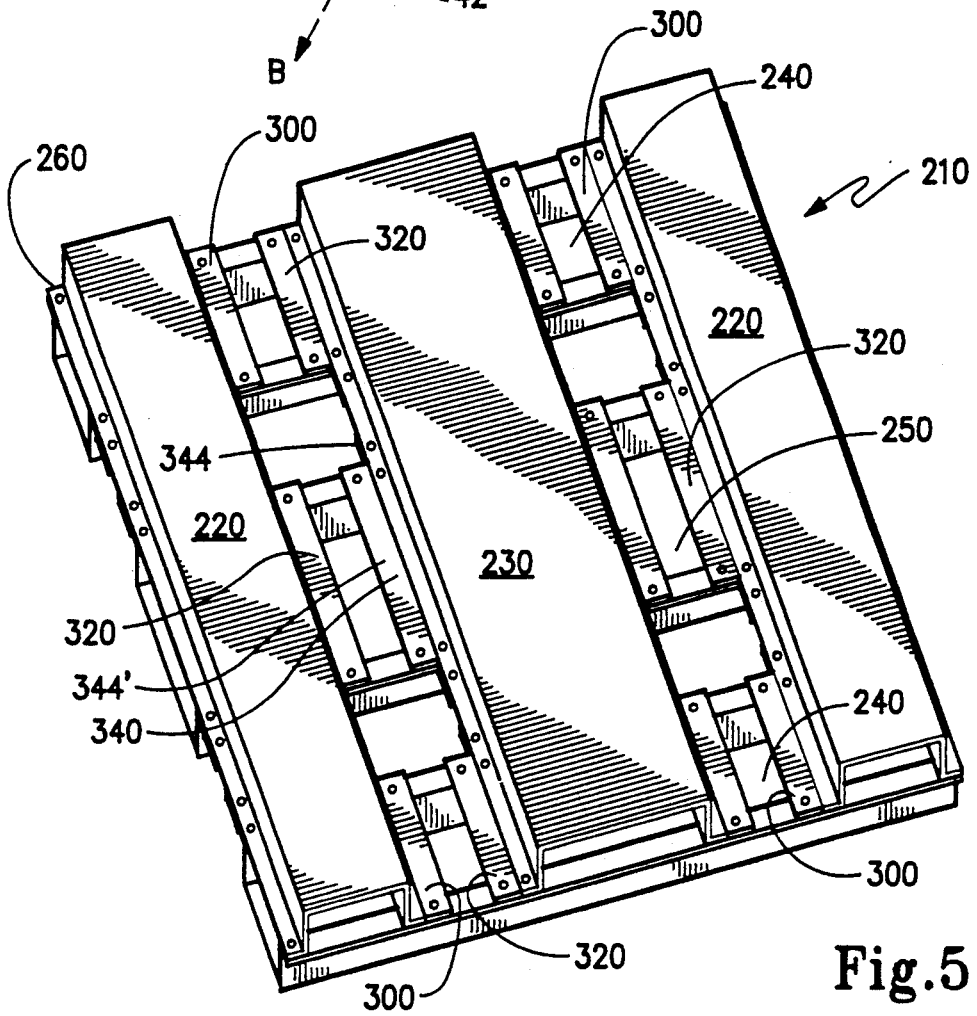
FIG. 5 is a perspective view of another alternative exemplary embodiment of the spacer device of the present invention which uses an enlarged central channel member on each side thereof and which uses strengthening plates at the intersection of the channel member.

Shown in FIG. 5 is another alternative embodiment of the present invention. Here, spacer device 210 has outer first central channel member 220 and a first central channel member 230 to define the first set of three first channel members. A second set of three second channel members includes outer second channel members 240 and second central channel member 250 again defining a set of three second channel members. As can be readily seen, the members 220, 230, 240 and 250 each have respective bottom walls, sidewalls and flanges the construction of which is the same as that described with respect to channel members 20, 40, 120, 130 and 140. First central channel member 230 is wider than outer first channel members 220 with each of the central and the first channel members each having a width again defined by the distance between its sidewalls. Second central channel member 250 is wider than outer second channel members 240. The width of the central first channel member 230 and the second central channel member 250 are preferably the same. Again, the channel width of the first and second central channel members is preferably at least 50% wider than the first and second outer channel members.

The embodiment shown in FIG. 5 employs rivets 260 as the attachment means for attaching channel members 220 and 230 to the respective channel members 240 and 250. These attachment means are located at attachment locations at the intersections of the respective outwardly disposed flanges as noted above with respect to crimping 60 Naturally, other attachment means such as screws, bolts, and the like are within the scope of this invention.

This alternative embodiment is most effectively employed between two layers of containers. Thus, the heat transferring surfaces provided by the enlarged widths of the bottom walls of the first and second central channel members contact containers at interior portions that are somewhat insulated by the outer containers. By enlarging the widths of the central channel members, the interior hot spots are reduced because the interior containers are exposed to a larger thermal transfer surfaces which allows the heat to transfer between the first and second channel members and the containers more efficiently. Also, the circulation of air is increased because the central channel cross-sections are enlarged.

Figure 6:
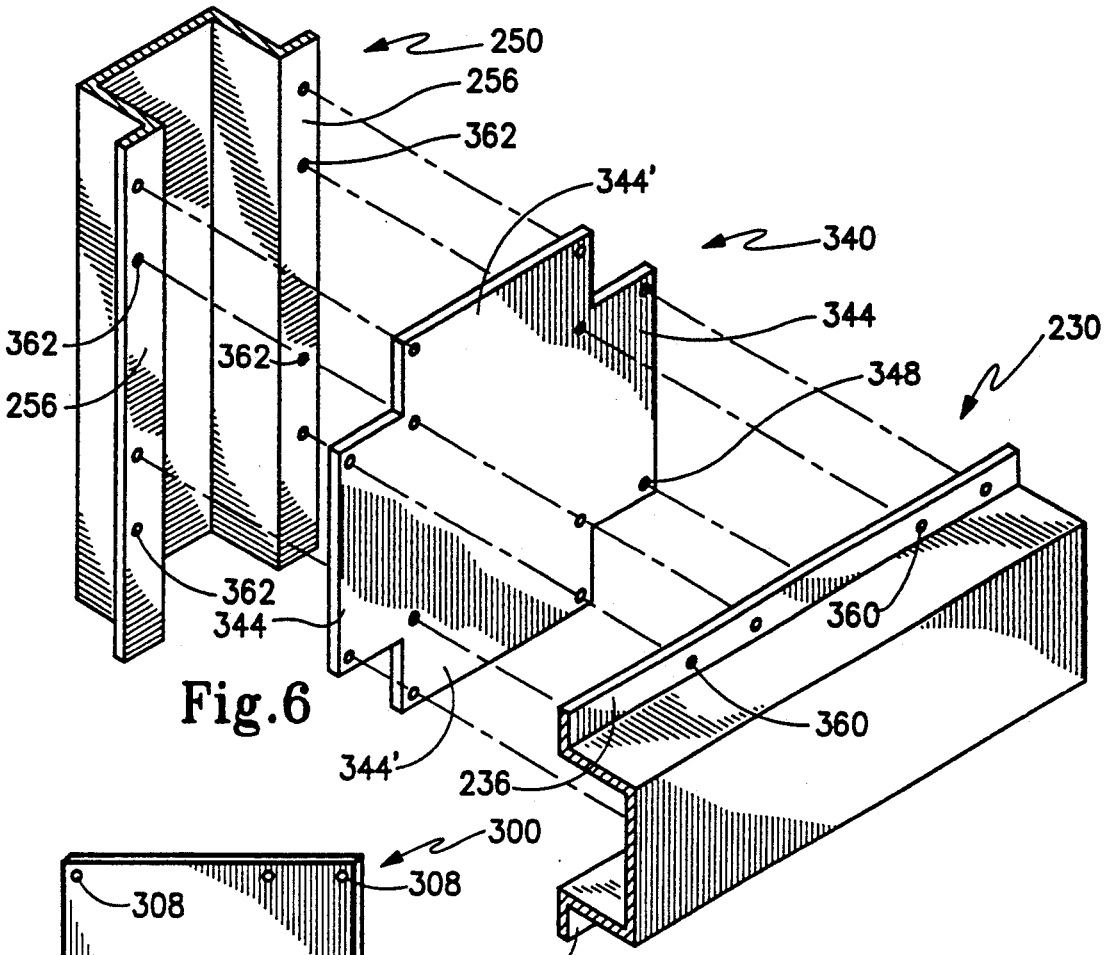
FIG. 6 shows an exploded view in perspective of an intersection of channel members according to the embodiment shown in FIG. 5 with an associated representative strengthening plate.

To increase both the strength of spacer device 210 and the radiant surface area, an additional structure is provided in the embodiment shown in FIG. 5 in the form of strengthening plates such as L-shaped corner plates 300, T shaped edge plates 320 and X-shaped center plate 340, and the innerpositioning of a representative one of these strengthening plates is shown with respect to X-shaped plate 340 shown in FIG. 6. The strengthening plates are preferably formed of the same metal as the U-shaped channels. These metals include steel, tin, copper, nickel, aluminum, iron and alloys thereof. Before discussing this construction, the structure of strengthening plates 300, 320 and 340 may first be reviewed in reference to FIGS. 7(*a*)–7(*c*).

Figure 7A:
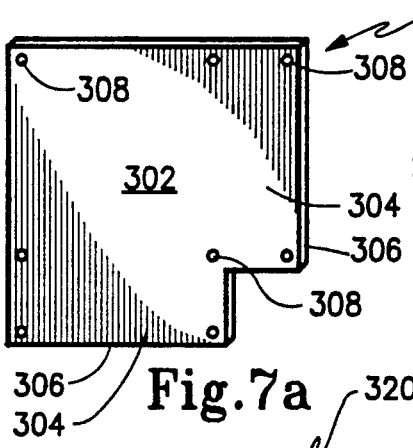
FIG. 7(*a*)–7(*c*) are perspective views of the L-shaped, T-shaped and X-shaped strengthening plates, respectively; used in the embodiment shown in FIGS. 5 and 6.
Figure 7C:
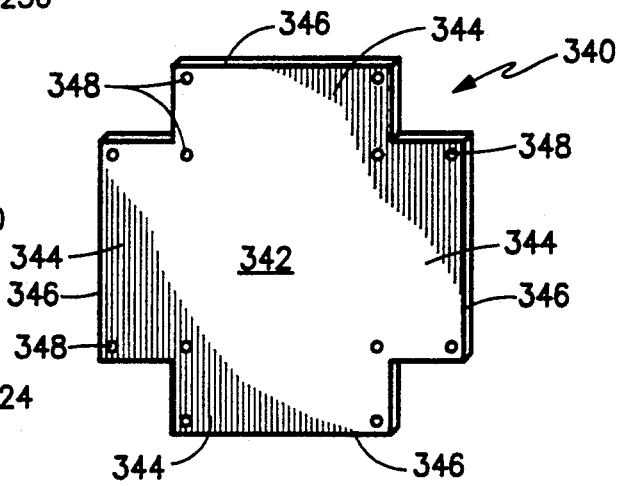
Figure 7B:
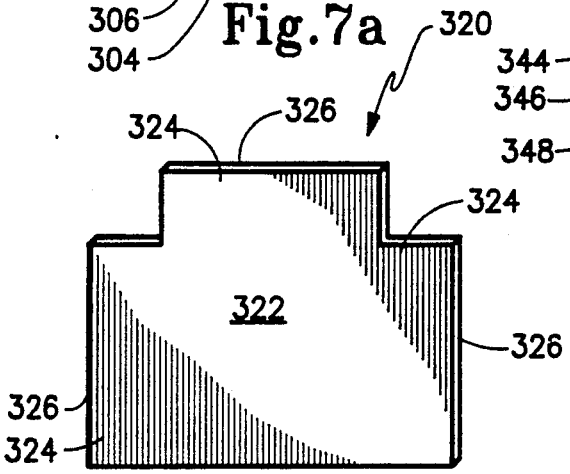

With respect to FIGS. 7(*a*)–7(*c*), then, it may be seen that each strengthening plate has a planar central section and a plurality of wings which project laterally therefrom and in a common plane therewith and terminate in an outer wing edge. Thus, for example, L-shaped corner plate 300, shown in FIG. 7(*a*), includes central section 302 and a pair of wings 304. Wings 304 terminate in outer wing edges 306 and plate 300 may be provided with a plurality of mounting holes, such as holes 308, adapted to receive rivets therethrough. These mounting holes are not necessary if crimping is used to secure the plates between the U-shaped channels. Similarly, T-shaped strengthening plate 320 includes a central section 322 and a plurality of wings 324 which project laterally therefrom to terminate in wing edges 326. Finally, X-shaped strengthening plate 340 includes central section 342 from which laterally project wings 344 that terminate in wing edges 346. Again rivet holes such as holes 348 extend through plate 340. Each of wings 304, 324 and 344 have a width as measured along their dimension adjacent their respective central sections 302, 322, and 342. The width of these wings is selected to be slightly greater than the width of the channel members between which they are disposed since the width should be sufficient to extend completely across the width of the respective channel member and its laterally projecting flanges. Plates 300, 320 and 340 are preferably made of metal similar to the channel members described above.

With reference now to FIG. 6, the interposition of strengthening plate 340 between central channel members 230 and 250 may be more fully appreciated, and it should also be appreciated that the innerpositioning of L-shaped corner plates 300 and T-shaped plates 320 would be similar at their corresponding channel member intersections. In FIG. 6, it may be seen that wings 344 are adapted to extend alongside flanges 336 of first central channel member 230 and extend between the oppositely facing flanges 236 to define additional attachment locations 360 so that auxiliary attachment means, such as additional rivets, may be inserted to mount wings 344 to flanges 236. Likewise, wings 344' extend along channel member 250 and between oppositely projecting flanges 256 to provide auxiliary attachment locations 362. This auxiliary attachment may also be seen with reference again to FIG. 5. These locations are depicted in FIG. 6, however, as holes 360 and 362 in their respective channel members 230 and 250. By including the strengthening plates at the intersections of the respective channel members, and by adding the auxiliary attachment locations and corresponding attachment means, the spacer device 210 is substantially strengthened and rigified against deformation caused by the weight of the containers placed thereon. The surface areas of the strengthening plates increases the available radiant surface area to air circulating through the channels with substantially reducing the air flow. This strengthening plate structure has been described with respect to the embodiment shown in FIG. 5, but it should be fully appreciated that strengthening plates could be used with the embodiment shown in FIG. 2 or FIG. 4, just as easily. It should be apparent to the ordinarily skilled person that the exact shape of the strengthening plate is dictated by the type of intersection it is supporting as well as by the width of the respective intersecting channels.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. A spacer device adapted to support containers having a first temperature in an environment having a second temperature and operative to rapidly allow thermal transfer of heat between the containers and the environment comprising:

a plurality of individual discrete elongated U-shaped first channel members each having a longitudinal axis and formed by a planar first bottom wall and a pair of first sidewalls connected to said bottom wall to form a U-shaped first channel, said first sidewalls each projecting upwardly from said first bottom wall and each terminating in a laterally projecting first flange with said first flanges oppositely projecting from one another in substantially parallel spaced apart relation to said first bottom wall, said first channel members organized as a first set with each of said first channel members in said first set being positioned in an equal spaced apart parallel relation to one another with the U-shaped first channels thereof opening in a common first direction;

a plurality of individual discrete elongated U-shaped second channel members each having a longitudinal axis and formed by a planar second bottom wall and a pair of second sidewalls connected to said second bottom wall to form a U-shaped second channel, said second sidewalls each projecting upwardly from said second bottom wall and each terminating in a laterally projecting second flange with said second flanges oppositely projecting from one another in substantially parallel spaced apart relation to said second bottom wall, said second channel members organized as a second set and with said second channel members in the second set being positioned in an equal spaced apart parallel relation to one another with the U-shaped channels thereof opening in a common spaced direction opposite the first direction and with each of said second channel members oriented transversely to said first channel members so that said first and second channel members cross one another at intersections so that said first and second flanges are in contact with one another at the intersection, at least some of said first and second flanges attached to one another at respective intersections in a manner sufficient to rigidly interconnected the first set of first channel members and the second set of second channel members so that said first and second bottom walls may be positioned in operation to contact and support said containers; and strengthening plates disposed between at least one of said first and at least one of said second channel members proximate said intersection of said first and second members.

2. A spacer device according to claim 1 wherein said first and second channel members are attached by a plurality of fasteners each having a selected size, each of first and second flanges having an outer edge and being sized and configured at the attachment locations to receive a respective fastener without substantial deformation of said outer edge.

3. A spacer device according to claim 1 wherein said first and second elongated U-shaped channel members each having a width defined by the distance between each pair of sidewalls, said first set of said first channel members including a first central channel member and a plurality of outer first channel members, said first central channel member having a width that is greater than the width of said outer first channel members.

4. A spacer device according to claim 1 wherein said first set includes a central first channel member and a plurality of outer first channel members with each of said central and said outer first channel members having a width defined by the distance between the respective first side walls of said central and of each of said outer first channel members, and wherein said second set includes a central second channel member and a plurality of outer second channel members with each of said central and said outer second channel members having a width defined by the distance between the respective side walls of said central and of each of said outer second channel members, and wherein the width of said central first and said central second channel members are greater than the width of said outer first and said outer second channel members, respectively.

5. A spacer device according to claim 1 wherein each of said plates has a planar central portion at the respective intersection and a plurality of wing portions extending outwardly from said central portion in a common plane therewith to project respectively alongside said first and second channel members which define the respective intersection to terminate in an outer wing edge whereby said wing portions extend across the flanges of the respective first and second channel members and including auxiliary attachment means for securing each of said wing portions to the associated said first and second flanges.

6. A spacer device according to claim 5 wherein said interconnected plates are selected from a group consisting of: L-shaped plates, T-shaped plates and X-shaped plates.

7. A spacer device according to claim 6 wherein each of said strengthening plates have a planar central portion at the respective intersection and a plurality of wing portions extending outwardly from said central portion in a common plane therewith to project respectively alongside said first and second channel members which define the respective intersection to terminate in an outer wing edge whereby said wing portions extend across the flanges of the respective first and second channel members, and including auxiliary attachment means for securing each of said wing portions to the associated said first and second flanges.

8. A spacer device according to claim 6 wherein said strengthening plates are selected from a group consisting of: L-shaped plates, T-shaped plates and X-shaped plates.

9. A spacer device according to claim 5 wherein said strengthening plates are formed of metal.

10. A spacer device according to claim 9 wherein said metal is selected from a group consisting of: steel, tin, aluminum, iron, copper, nickel.

11. A spacer device adapted to support containers having a first temperature in an environment having a second temperature and operative to rapidly allow thermal transfer of heat between the containers and the environment comprising:

a plurality of elongated U-shaped first channel member each having a longitudinal axis and formed by a planar first bottom wall and a pair of first sidewalls connected to said bottom wall to form a U-shaped first channel, said first sidewalls each projecting upwardly from said first bottom wall and each terminating in a laterally projecting first flange with said first flanges oppositely projecting from one another in substantially parallel spaced apart relation to said first bottom wall, said first channel members organized as a first set with each of said first channel members in said first set being positioned in a spaced apart parallel relation to one another with the U-shaped first channels thereof opening in a common first direction;

a plurality of elongated U-shaped second channel members having a longitudinal axis and formed by a planar second bottom wall and a pair of second sidewalls connected to said second bottom wall to form a U-shaped second channel, said second sidewalls each projecting upwardly from said second bottom wall and each terminating in a laterally projecting second flange with said second flange oppositely projecting from one another in substantially parallel spaced apart relation to said second bottom wall, said second channel members organized as a second set and with said second channel members in a second set being positioned in a spaced apart parallel relation to one another with the U-shaped channels thereof opening in a common second direction opposite the first direction and with each of said second channel members oriented transversely to said first channel members so that said first and second channel members cross one another at intersections so that said first and second flanges are proximate one another at the intersections;

a strengthening plate interposed between at least one of said first channel members and one of said second channel members proximate their respective intersection; and attachment means for attaching said first and second flanges at selected attachment locations at some of the intersections to rigidly interconnect the first set of first channel members and the second set of second channel members.

12. A spacer device according to claim 11 wherein said strengthening plates are formed of metal.

13. A spacer device according to claim 12 wherein said metal is selected from a group consisting of: steel, tin, aluminum, iron, copper, nickel.

* * * * *